US005377943A

United States Patent [19]

Perl

[11] Patent Number: 5,377,943

[45] Date of Patent: Jan. 3, 1995

[54] CHAIR BASE

[75] Inventor: Ludovic A. Perl, Willowdale, Canada

[73] Assignee: Shepherd Products, Inc., Canada

[21] Appl. No.: 172,600

[22] Filed: Dec. 21, 1993

[51] Int. Cl.[6] ..... A47B 91/00

[52] U.S. Cl. ..... 248/188.7; 248/157; 403/334

[58] Field of Search ..... 248/188.7, 188.8, 188.1, 248/132, 161, 157; 403/334, 361

[56] References Cited

U.S. PATENT DOCUMENTS

D. 109,152 4/1938 Powell .
D. 206,000 10/1966 Moore et al. .
D. 238,646 2/1976 Schoblom .
D. 260,639 9/1981 Long .
D. 273,823 5/1984 Ambasz et al. .
D. 273,925 5/1984 Caruso .
D. 304,399 11/1989 Caruso et al. .
D. 312,011 11/1990 Caruso et al. .
D. 321,299 11/1991 Caruso et al. .
4,529,247 7/1985 Stumpf et al. .
5,149,035 9/1992 Bonnema et al. ..... 248/188.7

*Primary Examiner*—Ramon O. Ramirez
*Attorney, Agent, or Firm*—Lee, Mann, Smith, McWilliams, Sweeney & Ohlson

[57] ABSTRACT

A chair base adapted to support a column and a chair seat. The chair base includes a hub having a central axis and a plurality of legs attached to and radially extending from the hub. A bore extends concentrically along the axis through the hub defining an interior wall within the hub. The interior wall includes an upper conical wall portion extending between a circular first upper edge and a circular first lower edge. The first upper edge has a larger diameter than the first lower edge such that the conical wall portion tapers inwardly and downwardly. The interior wall also includes a lower wall portion disposed below the upper conical wall portion which extends between a circular second upper edge and a circular second lower edge. The second upper edge of the lower wall portion has a diameter which is smaller than the diameter of the first lower edge of the upper conical wall portion. A generally annular wall portion extends between the second upper edge of the lower wall portion and the first lower edge of the conical wall portion. The annular wall forms an inwardly extending step for engaging the bottom end of the column when the column is inserted into the bore and thereby prevents the column from moving downwardly through the bore past a predetermined point during use.

7 Claims, 1 Drawing Sheet

CHAIR BASE

BACKGROUND OF THE INVENTION

The present invention is directed to a chair base adapted to support a column for supporting a chair seat and, in particular, to a chair base having a stepped hub to prevent creep of the column through the chair base.

Prior chair bases, of the type illustrated in Shepherd Products Design U.S. Pat. Des. Nos. 1312,011 and 321,299, have included a central hub from which a plurality of legs radially extend. The hubs in these prior chair bases generally include a bore extending vertically therethrough which forms a single conical wall portion within the hub. The conical wall portion of the hub is made entirely of plastic or includes a conical metal insert positioned within the bore of the hub. The bottom end of the column which is inserted into the bore of the chair base generally also includes a tapered conical wall adapted to engage the conical wall of the hub. As the tapered wall of the column is inserted into the bore of the hub the tapered wall of the column becomes wedged into engagement with the conical wall portion of the hub. This wedging effect of the column into the hub attaches the column to the chair base such that the top end of the column does not wiggle or deflect laterally.

Over time, as loads are repeatedly applied to the chair column, the bottom end of the column used with prior chair bases has been found to creep downwardly through the bore in the hub of the chair base from its originally installed position. As the column creeps downwardly, the conical wall of the column exerts increasingly greater forces on the hub and causes the formation of stress fractures in the hub wall thereby making the chair unsafe for further use as eventually a complete fracture of the hub will take place whereupon the column and attached chair may topple over. In those instances where the hub may not completely fracture, its internal diameter will continue to expand and the column will continue to creep downwardly until the bottom end of the column passes through the hub and hits the floor and thereafter drags therealong when the chair is moved horizontally. Even the use of steel sleeves as inserts within the bore of the hub has not been able to prevent the unwanted downward creep of the column through the hubs of prior chair bases.

The downward creep of the column through the hub of a chair base not only causes potential safety hazards due to the resulting stress fracturing of the hub and the potential sudden total fracturing of the hub, but also severely shortens the otherwise useful life of the chair base. There has therefore been a need for a chair base in which a column may be inserted and rigidly supported to prevent lateral deflection and which will also prevent the downward creep of the column through the hub of the chair base beyond a predetermined point.

SUMMARY OF THE INVENTION

The present invention provides a chair base adapted to support a column having a chair or other article attached thereto. The chair base includes a hub having a central vertical axis and a plurality of legs equally spaced about the hub and extending radially therefrom. A bore extends concentrically and vertically along the axis through the hub. The bore forms an inner wall having an upper tapered wall portion extending between a first upper edge and a first lower edge. The first upper edge defines a larger cross-sectional area than does the first lower edge such that the wail portion tapers inwardly and downwardly. The inner wall also includes a lower wall portion disposed below the upper tapered wall portion. The lower wall portion extends between a second upper edge and a second lower edge. The second upper edge of the lower wall portion defines a smaller cross-sectional area than does the first lower edge of the upper tapered wall portion. A peripheral wall portion extends between the second upper edge of the lower wall portion and the first lower edge of the tapered wall portion forming an inwardly extending step or ledge which engages the lower end of the column when the column is inserted into the bore. The step prevents the column from moving downwardly through the bore past the position at which the column engages the step.

DESCRIPTION OF THE PREFERRED EMBODIMENT

Figure 1:
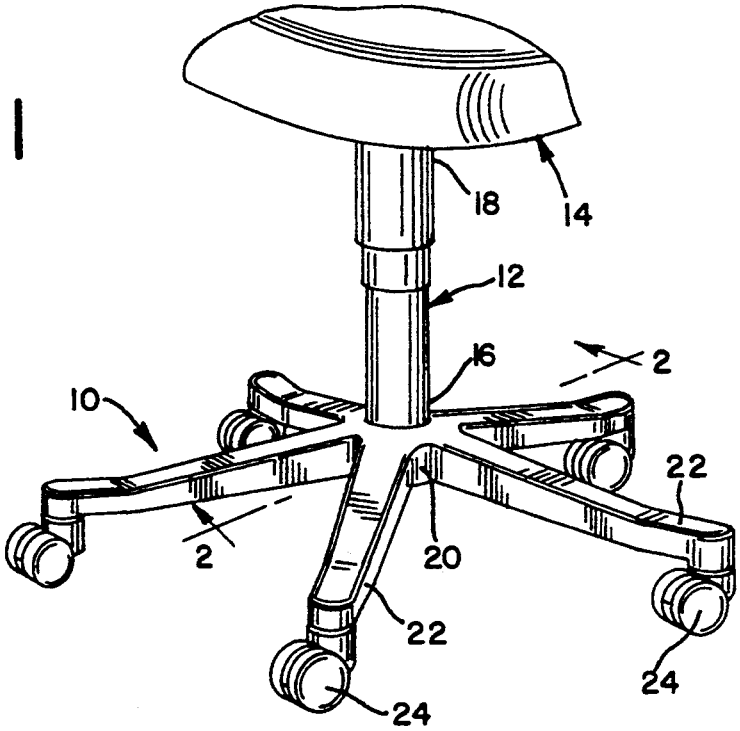
FIG. 1 is a perspective view of the chair base of the present invention shown supporting a column and the seat of a chair.

FIG. 1 shows the chair base 10 of the present invention supporting a column 12 and the seat 14 of a chair. The column 12 extends between a lower end 16 which is inserted into the chair base 10 and a top end 18 which is attached to the seat 14. Although the base 10 is referred to as a "chair base" herein and is shown in FIG. 1 supporting the seat 14 of a chair, the term "chair base" as used herein is to be broadly interpreted as a base for the support of various different types of articles such as stools, chairs, table tops, clothes racks and the like.

The chair base 10 as shown in FIG. 1 includes a central hub 20 and a plurality of legs 22. The legs 22 are equally spaced around the hub 20 and extend radially outwardly therefrom. A caster 24 may be attached to the end of each leg 22 to provide selective rolling movement of the chair base 10 over the surface of a floor. As an alternative, a foot (not shown) may be attached to each end of the legs 22 in place of the casters 24 to provide nonrolling support of the chair base 10 on a floor. The hub 20 and legs 22 are preferably made of plastic but may also be made of metal or other materials as desired.

Figure 3:
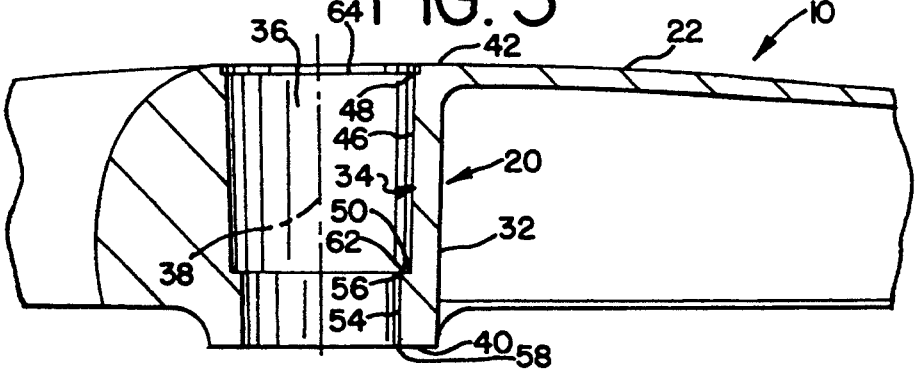
FIG. 3 is a partial cross sectional view of the chair base showing the hub of the present invention.

As best shown in FIG. 3, the hub 20 includes an outer generally cylindrical wall 32 and an inner wall 34 formed by a bore 36 which extends through the hub 20 concentrically along a vertical central axis 38. The inner and outer walls 32 and 34 of the hub 20 extend from a lower surface 40 to an upper surface 42. The legs 22 of the chair base 10 are preferably integrally molded to the outer wall 32 of the hub 20. Although the bore 36 is depicted herein as being circular it is within the purview of the present invention to utilize a bore of other geometric shape including for example rectangular or triangular or any other suitable configuration.

The inner wall 34 formed by the bore 36 includes an upper tapered conical wall portion 46 which extends between a circular upper edge 48 and a circular lower edge 50. The upper edge 48 has a diameter which is larger than the diameter of the lower edge 50 such that the conical wall portion 46 tapers inwardly and downwardly concentrically about the axis 38 at a predetermined angle. The upper conical wall portion 46 may be formed by a metal conical sleeve (not shown) positioned within the bore 36.

The inner wall 34 also includes a lower wall portion 54 which extends between a circular upper edge 56 and a circular lower edge 58. The upper edge 56 and the lower edge 58 are shown in FIG. 3 as having the same diameter and cross-sectional area such that the lower wall portion 54 is generally cylindrical. However, the upper and lower edges 56 and 58 could have different diameters and corresponding cross-sectional areas such that the lower wall portion 54 would be conical. The lower edge 58 preferably adjoins the lower annular surface 40 of the hub 20. The upper edge 56 of the lower wall portion 54 has a diameter and defines a cross-sectional area which is smaller than the diameter and cross-sectional area of the circular lower edge 50 of the upper conical wall portion 46.

Figure 2:
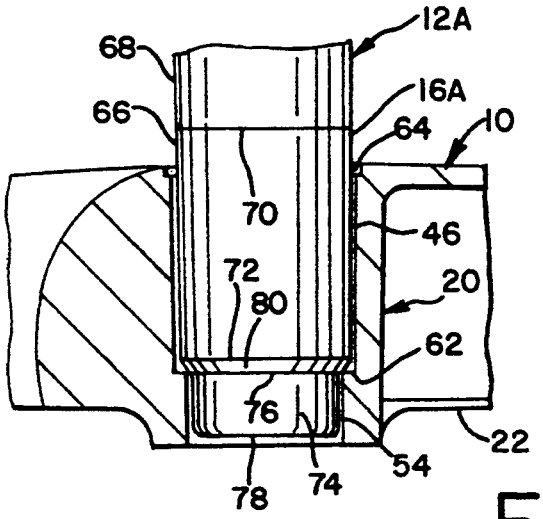
FIG. 2 is a partial cross sectional view of the chair base of the present invention taken along lines 2—2 of FIG. 1 showing one embodiment of column inserted therein.
Figure 4:
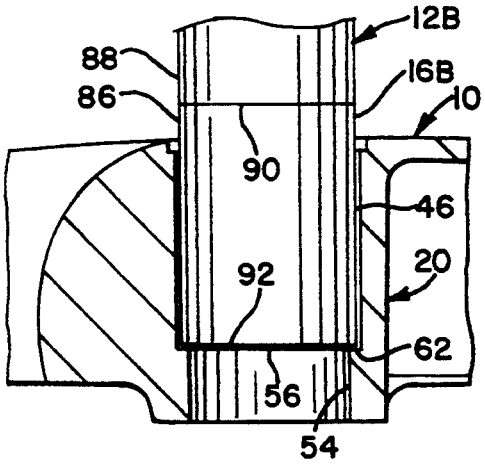
FIG. 4 is a partial cross sectional view of the chair base showing the hub of the present invention and an alternate embodiment of column inserted therein.

A generally annular peripheral wall portion 62 extends between the circular upper edge 56 of the lower wall portion 54 and the circular lower edge 50 of the upper conical wall portion 46. The annular wall portion 62 forms an inwardly extending step or ledge for engaging the bottom end 16 of the column 12 as best shown in FIGS. 2 and 4. The circular upper edge 56 of the lower wall portion 54 is preferably located in the same plane with the circular lower edge 50 of the upper conical wall portion 46 such that the annular wall portion 62 is generally planar. The plane in which the circular upper edge 56 of the lower wall portion 54 lies may alternatively be located either above or below the plane in which the circular lower edge 50 of the upper conical wall portion 46 lies such that the annular wall portion 62 is conical.

The circular upper edge 48 of the upper conical wall portion 46 is preferably located adjacent to the upper annular surface 42 of the hub 20 as shown in FIG. 3. It is preferred that the upper annular surface 42 of the hub 20 be slightly spaced apart from the column 12. An annular recess 64 is therefore provided between the upper edge 48 of the upper conical wall portion 45 and the upper annular surface 42 of the hub 20. If desired the upper edge 48 of the upper conical wall portion 46 may adjoin the annular surface 42.

The column 12 which is supported by the chair base 10 may be one of various different types of columns. The column 12 may be formed as a single piece having a fixed length and may be made from either plastic or metal. The column 12 may also be formed of multiple pieces and may include a housing and pneumatic or hydraulic mechanisms for selectively varying the length of the column and thereby the height of the seat 14. Although the columns 12 may be constructed in various different manners, the lower end 16 of the column 12 should preferably be constructed in one of two styles. FIGS. 2 and 4 show alternate embodiments of the lower end 16 of the column 12.

FIG. 2 shows a column 12A having a lower end 16A. The lower end 16A includes a generally conical wall 66 which extends downwardly from an upper cylindrical wall 68. The conical wall 66 tapers inwardly from an upper circular edge 70 to a lower circular edge 72. The lower circular edge 72 is smaller in diameter than the upper circular edge 70 such that the conical wall 66 tapers downwardly and inwardly. The conical wall 66 is preferably tapered at the same angle as the taper of the upper conical wall portion 46 of the hub 20 such that a large area of surface contact will be provided between the column 12A and the conical wall portion 46 of the hub 20 when the column 12A is fully inserted into the bore 36 of the hub 20. The lower end 16A also includes a cylindrical wall 74 which extends between an upper circular edge 76 and a lower circular edge 78. The cylindrical wall 74 is sized to fit within the lower wall portion 54 of the hub 20. The upper circular edge 76 of the cylindrical wall 74 is smaller in diameter than the lower circular edge 72 of the conical wall 66. A wall 80 extends between the upper circular edge 76 of the cylindrical wall 74 and the lower circular edge 72 of the conical wall 66 thereby forming an outwardly extending step. As shown in FIG. 2 the upper circular edge 76 may be located in a plane parallel to and slightly below the plane in which the lower circular edge 72 lies. The wall 80 is therefore generally conical and has a very steep taper as compared to the taper of the conical wall 66. The lower circular edge 72 of the conical wall 66 may alternately lie in the same plane as the upper circular edge 76 of the cylindrical wall 74 such that the wall 80 is generally planar.

As the lower end 16A of the column 12A is inserted into the bore 36 of the hub 20 the circular edge 78 of the cylindrical wall 74 will pass within and beyond the annular wall portion 62 which forms the inwardly extending step in the hub 20. As further insertion of the column 12A takes place, the conical wall 66 of the column 12A will begin to engage the conical wall 46 of the hub 20 such that the conical wall 66 will become wedged against the conical wall portion 46 with increasing force as the column 12A is further inserted downwardly into the hub 20. As the column 12A continues to be inserted into the hub 20 the outwardly extending step of the column 12A formed by the wall 80 will engage the inwardly extending step of the bore 20 formed by the annular wall portion 62. The engagement of the wall 80 against the annular wall portion 62 will prevent the column 12A from being further inserted downwardly through the bore 36 of the hub 20. As shown in FIG. 2 when the column 12A is fully inserted into the hub 20, the column 12A will be prevented from creeping downwardly through the bore 36 of the hub 20 during use by the annular wall portion 80 and the lower end 16A of the column 12A will be attached to the hub 20 by the wedging of the conical wall 66 within the upper conical wall 46 of the hub 20 such that the column 12A will not wiggle within the hub 20.

FIG. 4 shows a column 12B having a lower end 16B. The lower end 16B includes a conical wall 86 which extends downwardly from an upper cylindrical wall 88. The conical wall 86 extends between an upper circular edge 90 and a lower circular edge 92. The diameter of the lower circular edge 92 is smaller than the diameter of the upper circular edge 90 such that the conical wall 86 tapers downwardly and inwardly. The conical wall 86 preferably tapers at the same angle as the conical wall 46 of the hub 20 tapers. As the lower end 16B is inserted into the bore 36 of the hub 20 the conical wall 86 will come into contact with the conical wall 46 of the hub 20 and will become wedged within the conical wall 46 with increasingly greater force as the lower end 16B continues to be inserted into the hub 20. As the lower end 16B of the column 12B continues to be inserted into the hub 20, the lower circular edge 92 of the conical wall 86 will engage the annular wall 62 of the hub 20. The engagement of the lower circular edge 92 against the annular wall 62 of the hub 20 will prevent the column 12B from being further inserted into the hub 20 and will prevent the creep of the lower end 16B downwardly through the hub 20 during use.

Various features of the invention have been particularly shown and described in connection with the illustrated embodiments of the invention, however, it must be understood that these particular arrangements merely illustrate and that the invention is to be given its fullest interpretation within the terms of the appended claims.

What is claimed is:

1. A chair base adapted to support a column for a seat including:

a hub having a central axis;

a plurality of legs radially extending from said hub;

a bore extending concentrically along said axis through said hub defining an interior wall, said interior wall including an upper tapered wall portion extending between a first upper edge and a first lower edge, said first upper edge defining a larger cross-sectional area than said first lower edge such that said tapered wall portion tapers inwardly and downwardly;

a lower wall portion disposed below said upper wall portion extending between a second upper edge and a second lower edge, said second upper edge of said lower wall portion defining a smaller cross-sectional area than said first lower edge of said upper wall portion; and a peripheral wall portion extending between said second upper edge of said lower wall portion and said first lower edge of said tapered wall portion forming an inwardly extending step for engaging and supporting a lower end of the column when the column is inserted into said bore, said step adapted to limit the downward movement of the column within the bore and thereby prevent the column from moving past a predetermined location.

2. The chair base of claim 1 wherein said first upper edge of said upper wall portion and said second upper edge of said lower wall portion are generally circular.

3. The chair base of claim 2 wherein said upper tapered wall portion is generally conical.

4. The chair base of claim 1 wherein said second upper edge of said lower wall portion is generally circular.

5. The chair base of claim 1 wherein said peripheral wall portion comprises a generally planar surface.

6. The chair base of claim 1 wherein said second upper edge of said lower wall portion is generally located in the same plane as said first lower edge of said upper wall portion.

7. The chair base of claim 1 wherein said lower wall portion is generally cylindrical.

* * * * *